US007114217B2

(12) United States Patent
Matsuzawa et al.

(10) Patent No.: US 7,114,217 B2
(45) Date of Patent: Oct. 3, 2006

(54) BUFFER

(75) Inventors: Kazunari Matsuzawa, Sagamihara (JP); Hironori Awano, Fujisawa (JP)

(73) Assignee: NIFCO Inc., Yokohama (JP)

( * ) Notice: Subject to any disclaimer, the term of this patent is extended or adjusted under 35 U.S.C. 154(b) by 31 days.

(21) Appl. No.: 10/751,397

(22) Filed: Jan. 6, 2004

(65) Prior Publication Data

US 2004/0221424 A1 Nov. 11, 2004

(30) Foreign Application Priority Data

Feb. 21, 2003 (JP) ..... 2003-044707

(51) Int. Cl.
*E05F 5/02* (2006.01)

(52) U.S. Cl. ..... 16/2.2; 16/85; 16/86 R

(58) Field of Classification Search ..... 16/82, 16/85, 86 A, 86 R, 2.1–2.5; 296/207; 267/139–141, 267/141.2; 248/573, 574, 632–635; 411/383, 411/384, 535, 182, 349, 549, 550, 551
See application file for complete search history.

(56) References Cited

U.S. PATENT DOCUMENTS 4,653,968 A * 3/1987 Rapata et al. ..... 411/247
4,924,549 A * 5/1990 Morel et al. ..... 16/82
5,092,550 A * 3/1992 Bettini ..... 248/188.4
5,735,511 A * 4/1998 Stocker et al. ..... 267/140.13
6,507,976 B1 * 1/2003 Ichimaru ..... 16/82

FOREIGN PATENT DOCUMENTS

JP 6-27778 7/1994
JP 2000-21900 1/2002

* cited by examiner

*Primary Examiner*—Chuck Y. Mah
*Assistant Examiner*—Michael J. Kyle
(74) *Attorney, Agent, or Firm*—Manabu Kanesaka

(57) ABSTRACT

A buffer includes a grommet having a tube portion, an attaching portion and an elastic engaging piece projecting inside the tube portion; an engaging member having an engaging step portion provided on an outer surface thereof for engaging the elastic engaging piece to prevent the engaging member from coming out in a counter-insertion direction when the engaging member is inserted into the tube portion in an insertion direction; and a damper main member having an abutting portion provided in a middle in a longitudinal direction for abutting against the engaging member when the damper main member is inserted into the engaging member. A projecting length adjustable device is formed for moving the damper main member in the counter-insertion direction and for fixing a projecting length of the damper main member projecting from the grommet.

4 Claims, 5 Drawing Sheets

BUFFER

BACKGROUND OF THE INVENTION AND RELATED ART STATEMENT

The present invention relates to a buffer used as an impact stop member for adjusting a closing position of an opening-closing member such as a hood, trunk cover, or door of an automobile.

As an example of a conventional buffer, an engaging step portion of a damper main member engages an elastic engaging piece of a grommet to maintain a projecting length of the damper main member from the grommet. In a state wherein the projecting length of the damper main member is substantially maximized, the engaging step portion of the damper main member engages the elastic engaging piece of the grommet. Then, the damper main member is pushed into the grommet when an opening-closing member is closed, so that the projecting length from the grommet can be adjusted without rotating the damper main member.

When a collar is rotated to fix the projecting length of the damper main member, the engaging piece (engaging projecting portion) of the damper main member engages the elastic engaging piece of the grommet to raise the damper main member. It is not possible to increase the projecting length of the damper main member from the grommet (refer to Japanese Patent Publication (Kokai) No. 2002-21900).

In the conventional buffer, when the opening-closing member is closed, the damper main member is pushed into the grommet, so that the projecting length from the grommet can be adjusted without rotating the damper main member. However, a locking mechanism in which the opening-closing member is locked at a closed position has an over stroke. Accordingly, when the projecting length of the damper main member relative to the grommet is adjusted only by the closing operation of the opening-closing member, a space corresponding to the over stroke is created between the damper main member and the opening-closing member, so that the damper main member may not abut against the opening-closing member in the closed position.

Also, when the collar is rotated to fix the projecting length of the damper main member, the engaging step portion of the damper main member engages the elastic engaging piece of the grommet to raise the damper main member. Therefore, in a case that the damper main member is formed of a flexible resin, the engaging step portion of the damper main member may disengage from the elastic engaging piece of the grommet to raise the damper main member above a predetermined position. Accordingly, when the collar is rotated to fix the projecting length of the damper main member, it may be difficult to stop the damper main member at an appropriate position to properly fix the projecting length.

In view of the above-mentioned problems, the present invention has been made, and an object of the invention is to provide a buffer in which it is possible to remove the gap between the damper main member and the opening-closing member in the closed position by moving the damper main member just by an amount corresponding to the over stroke.

Further objects and advantages of the invention will be apparent from the following description of the invention.

SUMMARY OF INVENTION

In order to achieve the objects described above, according to an embodiment of the present invention, a buffer includes a grommet having a tube portion, an attaching portion for attaching the buffer to a member to be attached and an elastic engaging piece projecting inside the tube portion; an engaging member having an engaging step portion provided on an outer surface thereof for engaging the elastic engaging piece to prevent the engaging member from coming out in a counter-insertion direction when the engaging member is inserted into the tube portion in an insertion direction; a damper main member having an abutting portion provided at a middle in a longitudinal direction for abutting against the engaging member when the damper main member is inserted into the engaging member in the insertion direction; and projecting length adjustable fixing means for moving the damper main member in the counter-insertion direction relative to the engaging member for a predetermined distance and for fixing a projecting length of the damper main member projecting from the grommet.

According to the present invention, the damper main member may include a screw portion provided on a portion thereof not inserted into the engaging member when the damper main member is inserted into the engaging member in the insertion direction. Also, a collar including a screw portion engaging the screw portion of the damper main member is provided. The collar is rotated relative to the damper main member even after the collar abuts against the grommet, so that the projecting length of the damper main member projecting from the grommet is adjusted and fixed.

Preferably, a long groove may be provided in one of the engaging member and the damper main member along the insertion direction, and an elastic engaging claw may be provided on the other of the engaging member and the damper main member for engaging the long groove. Further, a stopper may be provided in the damper main member for controlling a movement of the damper main member in the counter-insertion direction.

DETAILED DESCRIPTION OF PREFERRED EMBODIMENTS

Figure 1:
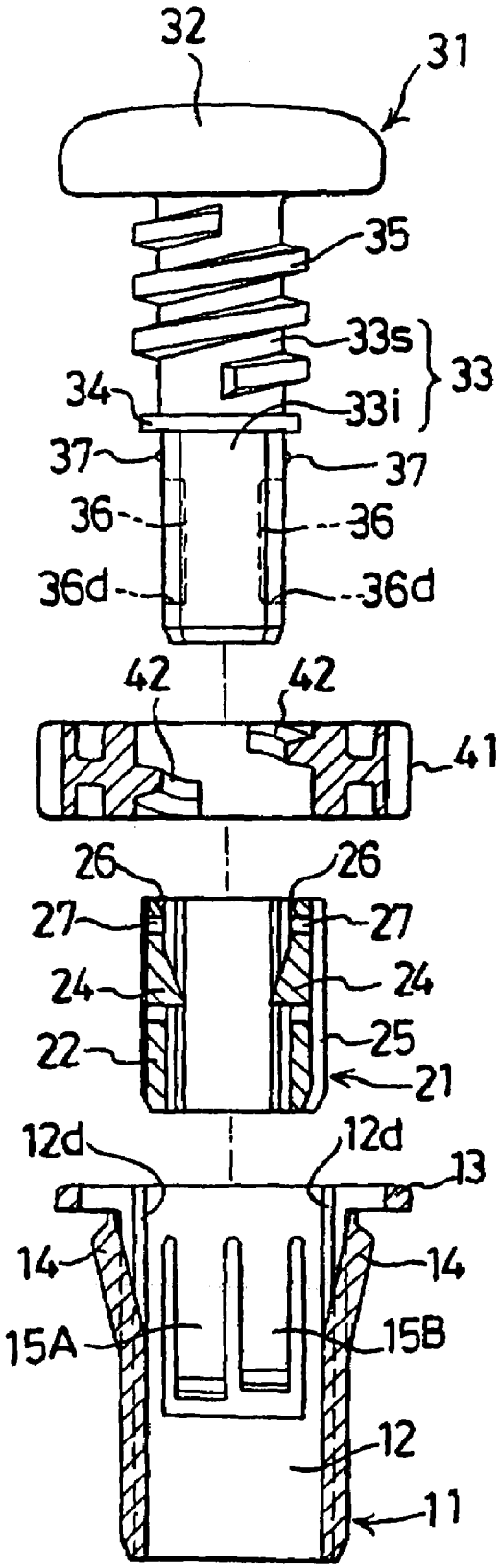
FIG. 1 is a partial sectional front view showing a buffer according to an embodiment of the present invention.
Figure 2:
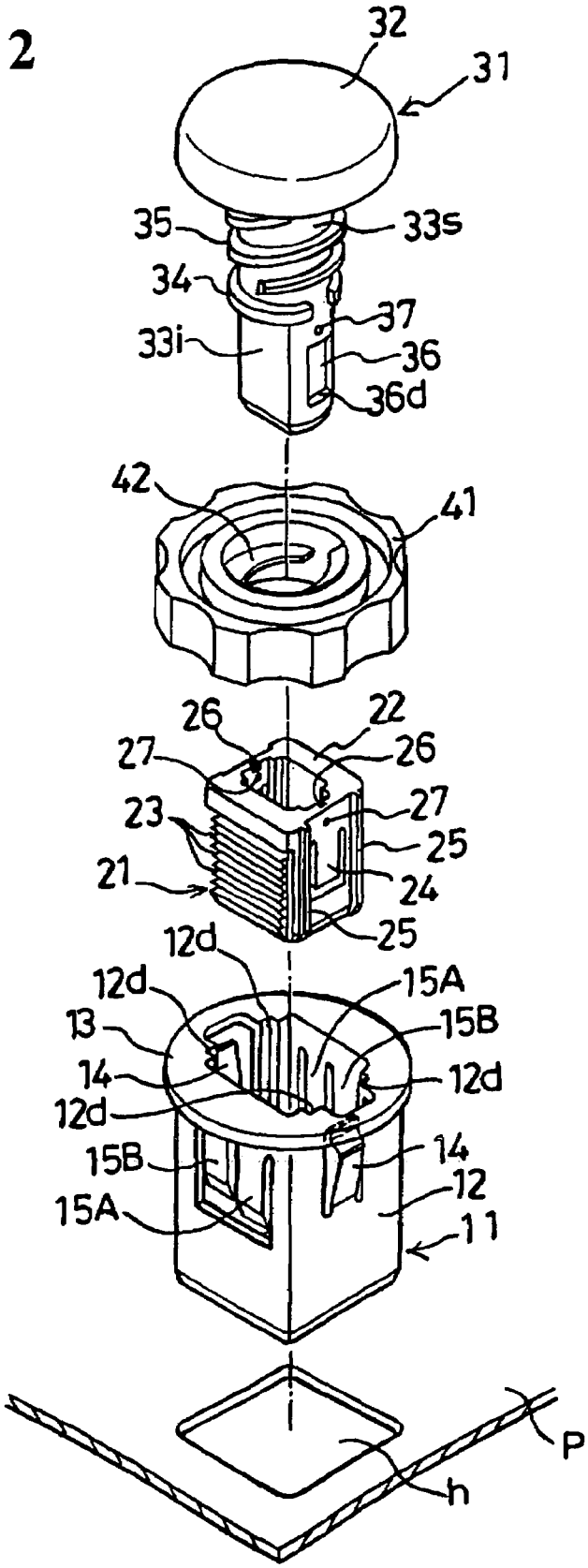
FIG. 2 is a perspective view of the buffer shown in FIG. 1.
Figure 3:
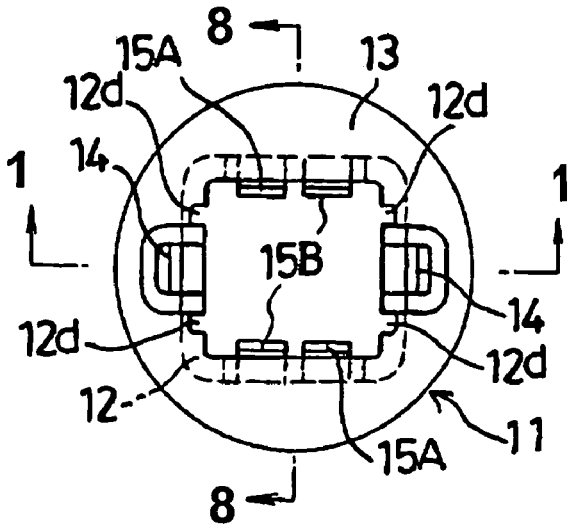
FIG. 3 is a plan view of a grommet shown in FIG. 1.
Figure 4:
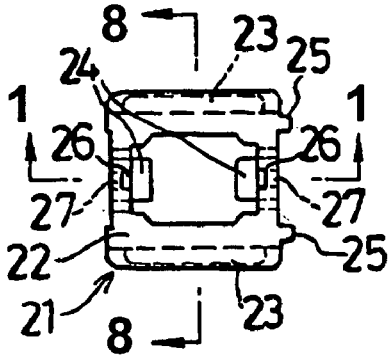
FIG. 4 is a plan view of an engaging member shown in FIG. 1.
Figure 5:
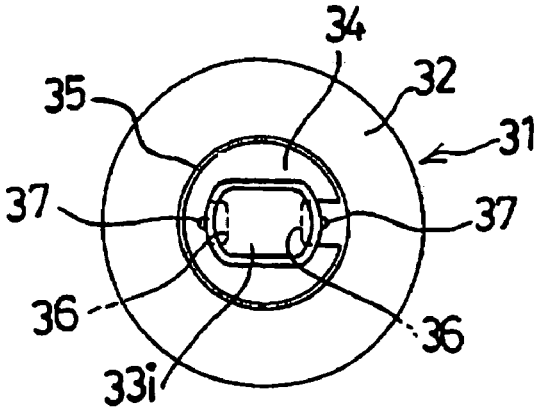
FIG. 5 is a bottom view of a damper main member shown in FIG. 1.
Figure 6:
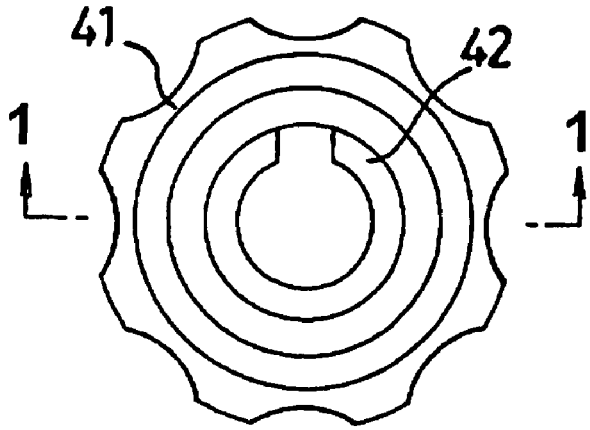
FIG. 6 is a plan view of a collar shown in FIG. 1.

Hereinafter, preferred embodiments of the invention will be explained with reference to the accompanying drawings. FIG. 1 is a partial sectional front view showing a buffer according to an embodiment of the present invention; FIG. 2 is a perspective view of the buffer shown in FIG. 1; FIG. 3 is a plan view of a grommet shown in FIG. 1; FIG. 4 is a plan view of an engaging member shown in FIG. 1; FIG. 5 is a bottom plan view of a damper main member shown in FIG. 1; FIG. 6 is a plan view of a collar shown in FIG. 1;

and FIGS. 7–10 are drawings for explaining a process of attaching the buffer to a panel and a process of adjusting a projecting length of the damper main member.

Figure 7:
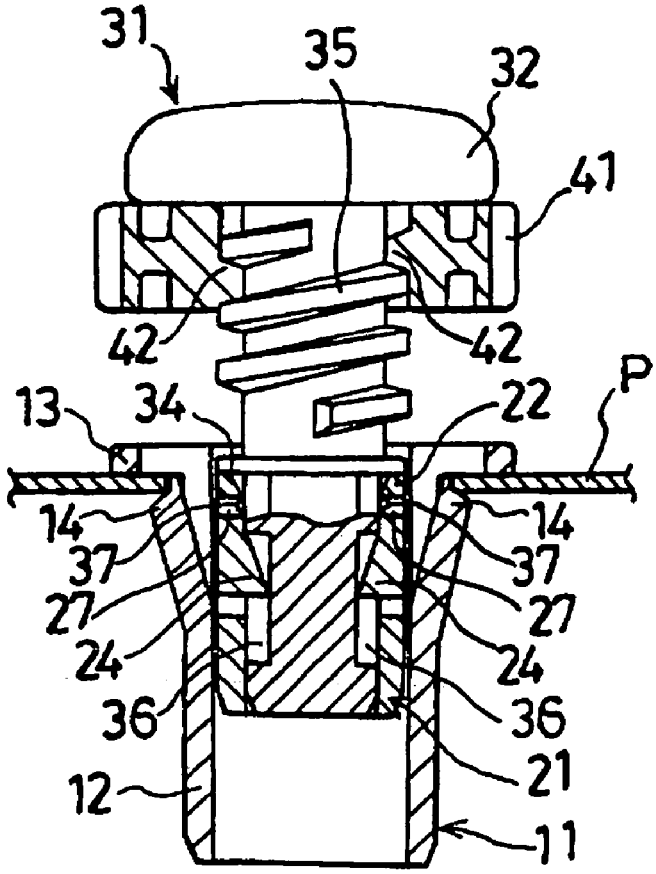
FIG. 7 is a drawing for explaining a state wherein the buffer is attached to a panel.
Figure 8:
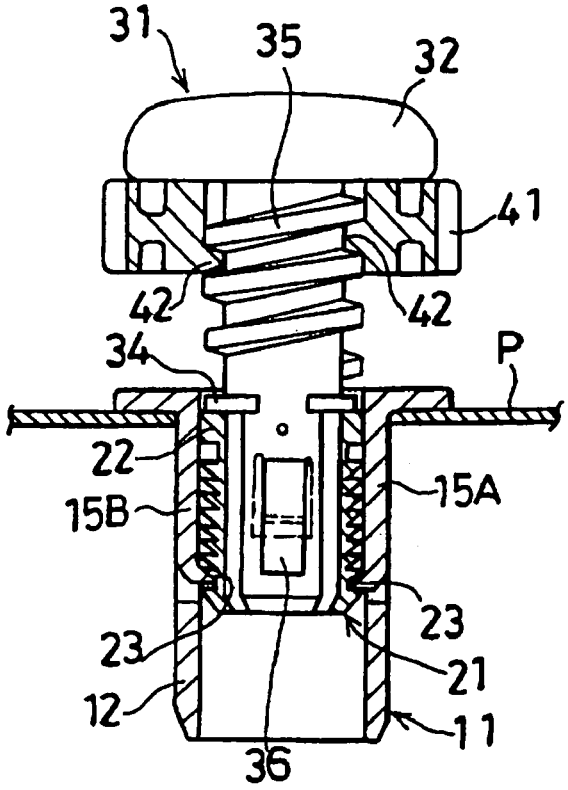
FIG. 8 is a drawing for explaining the state wherein the buffer is attached to the panel.
Figure 9:
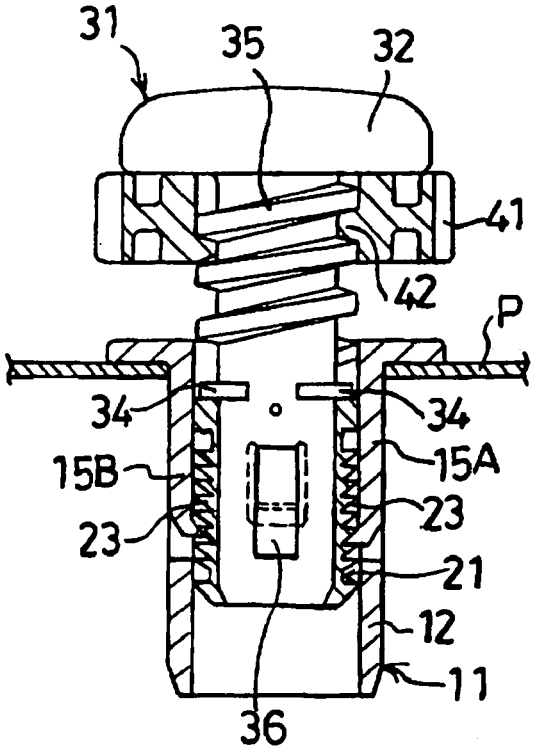
FIG. 9 is a drawing showing a process of adjusting a projecting length of the damper main member of the buffer according to the embodiment of the invention.

In FIGS. 1, 7 and 10, the grommet is shown in sectional views taken along line 1—1 in FIG. 3. In FIGS. 8 and 9, the grommet is shown in sectional views taken along line 8—8 in FIG. 3. In FIGS. 1, 7 and 10, the engaging member is shown in sectional views taken along line 1—1 in FIG. 4. In FIGS. 8 and 9, the engaging member is shown in sectional views taken along line 8—8 in FIG. 4. Also, in FIG. 1, the collar is shown in a sectional view taken along line 1—1 in FIG. 6.

A grommet 11 is formed of a synthetic resin, and includes a tube portion 12 having a rectangular shape; a flange 13 extending outwardly and provided around an upper end (one end) of the tube portion 12; elastic supporting pieces 14 provided respectively at opposing positions on the tube portion 12 for supporting a panel P (attaching member) along with the flange 13; and elastic engaging pieces 15A and 15B provided respectively at opposing positions on the tube portion 12 and extending inwardly toward an lower end (the other end) from the flange 13.

A rectangular opening is provided in the tube portion 12 so that an engaging member 21 (described later) can be inserted in a right direction, and guiding grooves 12*d* are provided in an axial direction at both edges of the inner surface where the elastic supporting pieces 14 are provided. Each of the elastic engaging pieces 15A has an engaging portion at a lower inner end thereof, and each of the elastic engaging pieces 15B also has an engaging portion at a lower inner end thereof. The engaging portions on the elastic engaging pieces 15A are shifted from the engaging portions on the elastic engaging pieces 15B in the vertical direction by a half pitch of engaging step portions 23 provided on the engaging member 21.

The flange 13 and the elastic supporting pieces 14 form an attaching portion for attaching the tube portion 12. A distance between edges (lower ends) of the elastic engaging pieces 15A and 15B is smaller than a width of the engaging step portions 23 of the engaging member 21. The elastic engaging pieces 15A (elastic engaging piece 15B) are provided at symmetrical positions relative to the axis of the tube portion 12, so that the elastic engaging pieces 15A and 15B horizontally engage the engaging step portions 23 of the engaging member 21.

The engaging member 21 is formed of a synthetic resin, and includes a tube portion 22 having a rectangular shape, so that the tube portion 22 can be inserted into the tube portion 12 of the grommet 11 correctly. The tube portion 22 has a substantially rectangular opening, so that a damper main member 31 (described later) is inserted in a right direction and does not rotate inside the tube portion 22. The engaging step portions 23 are formed with 1 mm pitch in a horizontal direction on outer surfaces (outside) of the tube portion 22 corresponding to the elastic engaging pieces 15A and 15B of the grommet 11.

Elastic engaging claws 24 are provided on opposing positions of the tube portion 22 corresponding to the elastic supporting pieces 14 of the grommet 11, and are oriented to approach each other toward edges (lower ends) for functioning as a stopper (stopper mechanism). Engaging projections 25 are provided on opposing positions corresponding to the elastic supporting pieces 14 of the grommet 11 for engaging and guiding the guiding grooves 12*d* of the grommet 11.

Further, guiding grooves 26 are provided on the tube portion 22 at upper inner ends where the elastic engaging claws 24 are provided, and include inclined faces reduced in length toward the lower ends for guiding the engaging projections 37 of the damper main member 31. Engaging holes 27 are provided below the guiding grooves 26 as engaging portions for engaging the engaging projections 37 of the damper main member 31.

Incidentally, each of the engaging step portions 23 has a flat upper surfaces and inclined side surfaces inclined from outside of the upper surface toward the lower end of the tube portion 22. Each of the elastic engaging claws 24 has a side surface inside the tube portion 22 inclined toward the lower end of the tube portion 22, and a flat lower surface.

The damper main member 31 is formed of a rubber, and includes a head portion 32 with a disk shape and a shaft portion 33 integrated with the head portion 32 and extending downwardly from the center of a lower surface of the head portion 32. The shaft portion 33 includes a cylindrical shaft portion 33*s* at an upper side thereof not to be inserted into the engaging member 21; and an I-cut shaft portion 33*i* extending downwardly from the cylindrical shaft portion 33*s* with the same axis, to be inserted into the engaging member 21, and having opposing portions cut in parallel in the axial direction.

The cylindrical shaft portion 33*s* is provided with an abutting flange 34 around a lower end thereof for abutting against the engaging member 21 as an abutting portion when the I-cut shaft portion 33*i* is inserted into the engaging member 21, and a male screw 35 above the abutting flange 34. Long grooves 36 are provided in the I-cut shaft portion 33*i* along an axial direction thereof at circular periphery surfaces thereof corresponding to the elastic engaging claws 24 of the engaging member 21 for engaging the elastic engaging claws 24, and substantially hemispheric engaging projections 37 are provided above the long grooves 36. Incidentally, one part of the abutting flange 34 is notched in the axial direction for easily inserting the cylindrical shaft portion 33*s* into a collar 41 (described later). Also, step portions 36*d* of the long groove 36 at the lower ends contact the lower ends of the elastic engaging claws 24 of the engaging member 21, and function as stoppers (stopper mechanism) for restricting the damper main member 31 to move upwardly.

A collar 41 with a disk shape is formed of a synthetic resin, and includes a female screw 42 at an inside for engaging the male screw 35. A part of the female screw 42 is notched in the axial direction so that the abutting flange 34 passes through. The panel P is a member to which the buffer is to be attached, and a square attaching hole h is provided for receiving the tube portion 12 of the grommet 11.

Incidentally, an inserting direction is a direction from the top (upper side) to the bottom (lower side) in FIG. 1, and a counter inserting direction is a direction from the bottom (lower side) to the top (upper side).

A process of assembling the buffer will be explained next. First, as shown in FIGS. 1 and 2, a lower end of the I-cut shaft portions 33*i* of the damper main member 31 faces an opening of the female screw 42 of the collar 41, and the I-cut shaft portion 33*i* is inserted into the female screw 42. In a case that the abutting flange 34 abuts against the female screw 42, the damper main member 31 is inclined relative to the collar 41, and one end of the notched part of the abutting flange 34 is inserted into the notched part of the female screw 42. When the damper main member 31 is rotated relative to the collar 41, the abutting flange 34 is screwed-into the female screw 42 and passes through the female screw 42. As a result, the collar 41 is located outside the cylindrical shaft portion 33*s*.

When the male screw 35 is screwed into the female screw 42 and the collar 41 is raised to abut against the head portion 32 as shown in FIGS. 7 and 8, the collar 41 is attached to the damper main member 31.

After the collar 41 is attached to the damper main member 31, the lower end of the I-cut shaft portion 33*i* of the damper main member 31 faces the opening of the tube portion 22 (engaging member 21), and the I-cut shaft portion 33*i* is inserted into the tube portion 22 from the top. Accordingly, the lower end of the I-cut shaft portion 33*i* expands the elastic engaging claws 24, and the I-cut shaft portion 33*i* is further inserted into the tube portion 22. When the lower end of the I-cut shaft portion 33*i* passes the elastic engaging claws 24 and a lower end of the elastic engaging claws 24 faces the long grooves 36, the elastic engaging claws 24 return to their original states with their own elasticity, and move into the long grooves 36 as shown in FIG. 7. As a result, the elastic engaging claws 24 are guided by the long grooves 36 and move up and down, so that the damper main member 31 moves up and down relative to the engaging member 21.

In the state that the elastic engaging claws 24 engage the long grooves 36 as described above, when the I-cut shaft portion 33*i* is further inserted into the tube portion 22, the engaging projections 37 are guided by the guiding grooves 26 and bent inwardly, so that the I-cut shaft portion 33*i* is further inserted into the tube portion 22. When the abutting flange 34 abuts against the upper end of the tube portion 22, the engaging projections 37 face the engaging holes 27, so that the engaging projections 37 return to their original state with elasticity and move into the engaging holes 27 as shown in FIG. 7. Therefore, the engaging member 21 is fixed relative to the damper main member 31.

Then, as shown in FIGS. 1 and 2, the lower end of the engaging member 21 faces the opening of the tube portion 12 (grommet 11), and the engaging projections 25 face the guiding grooves 12*d*. When the engaging member 21 is inserted into the tube portion 12, the lower end of the engaging member 21 pushes the elastic engaging claws 15A and 15B to open. As a result, the engaging member 21 is further inserted into the tube portion 12. The engaging member 21 is inserted into the tube portion 12 up to a state shown in FIG. 8 in which the engaging portions of the elastic engaging claws 15A pass the lowermost steps of the engaging step portions 23 to engage, thereby completing the assembly. Incidentally, in the assembled state, the engaging portions of the elastic engaging claws 15B are positioned on the second steps from the bottom of the engaging step portions 23.

A process of attaching the buffer will be explained next. First, when the lower end of the tube portion 12 faces the attaching hole h of the panel P and the grommet 11 is pressed toward the panel P as shown in FIG. 2, the elastic supporting pieces 14 partially projecting from a periphery of the tube portion 12 are pressed by an edge of the panel P to bend inwardly, so that the tube portion 12 is inserted into the attaching hole h. When the elastic supporting pieces 14 pass through the panel P and the flange 13 abuts against an upper surface of the panel P, the elastic supporting pieces 14 return to their original states with their own elasticity to abut against a lower surface of the panel P. Accordingly, as shown in FIG. 7, the panel P is supported by both the flange 13 and the elastic supporting pieces 14, so that the tube portion 12, i.e. the buffer, is attached to the panel P.

Incidentally, after the grommet 11 is attached to the panel P, the engaging member 21 with the damper main member 31 and the collar 41 may be attached to the grommet 11.

A process of adjusting and fixing a projecting length of the damper main member will be explained next. First, when a hood. (opening-closing member, not shown) is closed downwardly to abut against the top of the damper main member 31 in the state shown in FIGS. 7 and 8, the hood moves down to a position lower than a closed position by an over-stroke, and then moves up to the closed position. Accordingly, the damper main member 31 and the engaging member 21 pressed by the abutting flange 34 are also moved downwardly to a position lower than the closed position of the hood by the over-stroke shown in FIG. 9.

When the engaging member 21 moves downwardly, the elastic engaging pieces 15A and 15B expand and move downwardly over several steps of the engaging step portions 23. The elastic engaging pieces 15A or 15B engage certain positions of the engaging step portions 23 to prevent the engaging member 21 from coming out upwardly (counter-insertion direction).

After the hood is opened, the collar 41 is rotated relative to the damper main member 31. After the collar 41 abuts against the flange 13 (grommet 11) the collar 41 is further rotated. At this time, the engaging member 21 does not move upwardly as the elastic engaging pieces 15A or 15B engage the engaging step portions 23. Accordingly, the damper main member 31 projects a specific length, i.e. a predetermined projecting length. For example, the damper main member 31 projects (moves) until the elastic engaging claws 24 abut against the step portions (stoppers) 36*d* at the lower ends of the long grooves 36, so that it is possible to adjust the projecting length of the damper main member 31.

When the projecting length of the damper main member 31 is adjusted and fixed as described above, the damper main member 31 does not move vertically. Accordingly, the damper main member 11 abuts against the hood at the closed position without leaving a space between the damper main member 11 and the hood in the closed position.

Incidentally, when the projecting length of the damper main member 31 is adjusted, the engaging projections 37 pass through the engaging holes 27, and move to the upper side of the flange 13. The projecting length of the damper main member 31 can not be made longer than the predetermined projecting length. The projecting length of the damper main member 31 can be made shorter than the predetermined projecting length.

As described above, according to the embodiment of the present invention, the projecting length of the damper main member 31 pushed into the grommet 11 through the engaging member 21 relative to the grommet 11 can be adjusted by rotating the collar 41 with the female screw 42 engaging the male screw 35 provided in the damper main member 31. Therefore, when the projecting length of the damper main member 31 relative to the grommet 11 is adjusted just by the over-stroke of the opening-closing member, the damper main member 31 abuts against the opening-closing member at the closed position.

Further, the elastic engaging claws 24 are provided in the engaging member 21 and the long grooves 36 engaging the elastic engaging claws 24 are provided in the damper main member 31. Therefore, it is easy to attach the engaging member 21 to the damper main member 31. The elastic engaging claws 24 and the step portions 36*d* are provided for restricting the damper main member 31 to move in the counter-insertion direction. Therefore, it is possible to adjust the projecting length (moving distance) of the damper main member 31. When the projecting length of the damper main member 31 (moving distance) is set to be the over-stroke, it is possible to easily and accurately adjust the projecting length just by the over-stroke.

As described above, the step portions 36*d* of the long grooves 36 are perpendicular to the abutting surfaces of the elastic engaging claws 24 abutting against and engaging the step portions 36*d* relative to the counter-insertion direction of the damper main member 31. Therefore, when the projecting length of the damper main member 31 is adjusted, it is possible to securely fix the damper main member 31 at the predetermined position, and properly fix the projecting length of the damper main member 31. The engaging holes 27 are provided in the engaging member 21, and the engaging projections 37 are provided in the damper main member 31. Therefore, it is possible to assemble the engaging member 21 and the damper main member 31 without wobbling by engaging the engaging projections 37 with the engaging holes 27.

The elastic engaging pieces 15A and the elastic engaging pieces 15B have the pitch half of that of the engaging step portions 23. Therefore, when the damper main member 31 moves until the elastic engaging claws 24 abut against the step portions 36*d* to adjust the projecting length, the projecting length is adjusted with an error of half pitch of the engaging step portions 23, for example, in a range of (0±0.25) mm.

In the embodiment described above, the damper main member 31 includes the head portion 32. Even when the damper main member 31 does not have the head portion 32, the damper main member works in the same way as the embodiment. The abutting flange 34 of the damper main member 31 abuts against the engaging member 21. Alternatively, a step portion formed between the cylindrical shaft portion 33*s* and the I-cut axial portion 33*i* may be formed to abut against the engaging member 21.

Further, the elastic engaging claws 24 are provided in the engaging member 21 and the long grooves 36 are provided in the damper main member 31. Alternatively, the long grooves may be provided in the engaging member and the elastic engaging claws may be provided in the damper main member for expanding from lower portions to upper portions, so that the same function is obtained. The step portions of the long grooves (step portions at the upper side) may be used as the stoppers.

The engaging holes 27 are provided in the engaging member 21 and the engaging projections 37 are provided in the damper main member 31. Alternatively, the engaging projections (engaging portions) may be provided in the engaging member and the engaging holes (engaging portions) may be provided in the damper main member, so that the same function is obtained. The means for adjusting the projecting length comprises the male screw 35 of the damper main member 31 and the collar 41. Alternatively, other structure may be used for continuously adjusting the projecting length of the damper main member 31.

As described above, according to the present invention, the means is provided for adjusting and fixing the projecting length relative to the grommet of the damper main member pushed into the grommet through the engaging member. The screw portion is provided in the damper main member, and the collar with the screw portion engaging the screw portion in the damper main member is rotated to adjust the projecting length. Therefore, the damper main member abuts against the opening-closing member in the closed position by adjusting the projecting length relative to the grommet of the damper main member just by the over-stroke of the opening-closing member.

Further, the long grooves are provided in one of the engaging member and the damper main member along the insertion direction, and the elastic engaging claws engaging the long grooves are provided on the other of the engaging member and the damper main member. Therefore, it is easy to attach the engaging member to the damper main member. The stoppers are also provided for restricting the damper main member to move in the counter-insertion direction. Accordingly, it is possible to adjust the moving distance of the damper main member. When the projecting length of the damper main member, i.e. the moving distance, is set to be the over-stroke, it is possible to easily and accurately adjust the projecting length just by the over-stroke.

While the invention has been explained with reference to the specific embodiments of the invention, the explanation is illustrative and the invention is limited only by the appended claims.

What is claimed is:

1. A buffer to be attached to an attaching member, comprising:

a grommet having a hollow tube portion, an attaching portion for holding said grommet to said attaching member, and an elastic engaging piece projecting inside said tube portion, an engaging member slidably disposed in said hollow tube portion and having engaging step portions for engaging said elastic engaging piece, a damper main member slidably disposed in said engaging member and having an abutting portion at a middle portion thereof in a longitudinal direction for abutting against said engaging member, and a first screw portion disposed above said abutting portion, and means disposed between said engaging member and said damper main member for moving said damper main member in a direction away from said engaging member and fixing said damper main member relative to said engaging member so that said damper main member projects from said grommet by a desired distance, said means comprising a collar having a second screw portion for engaging said first screw portion of said damper main member, and said collar capable of being rotated, after said collar abuts against said grommet, wherein one of said engaging member and said damper main member includes a long groove provided along a direction that the damper main member slides in the engaging member, and the other of said engaging member and said damper main member includes an elastic engaging claw engaging the long groove.

2. A buffer according to claim 1, wherein said damper main member further includes a stopper for restricting the damper main member from moving in a counter-insertion direction, said stopper being formed at one end of the long groove.

3. A buffer according to claim 2, wherein said damper main member further includes a lower portion formed below the abutting portion and having non-circular walls inserted into the engaging member.

4. A buffer according to claim 3, wherein said lower portion has the long groove with the stopper, and the engaging member has the engaging claw.

* * * * *